US009038290B2

(12) United States Patent
Tamminga et al.

(10) Patent No.: US 9,038,290 B2
(45) Date of Patent: May 26, 2015

(54) IRON FEATURING LIQUID PHASE GARMENT MOISTURIZATION

(75) Inventors: Stephanus Tamminga, Eindhoven (NL); Johannes De Vries, Eindhoven (NL); Paulus Duineveld, Eindhoven (NL); Klaas Kooijker, Eindhoven (NL); Sepas Setayesh, Eindhoven (NL); Chee Keong Ong, Eindhoven (NL); Kok Wah Ma, Eindhoven (NL); Hee Keng Chua, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 13/813,525

(22) PCT Filed: Jul. 13, 2011

(86) PCT No.: PCT/IB2011/053127

§ 371 (c)(1), (2), (4) Date: Jan. 31, 2013

(87) PCT Pub. No.: WO2012/020340

PCT Pub. Date: Feb. 16, 2012

(65) Prior Publication Data

US 2013/0125428 A1 May 23, 2013

(30) Foreign Application Priority Data

Aug. 12, 2010 (EP) ..... 10172617

(51) Int. Cl.

*D06F 75/22* (2006.01)
*D06F 87/00* (2006.01)
*D06F 75/08* (2006.01)

(52) U.S. Cl.

CPC ..... *D06F 87/00* (2013.01); *D06F 75/22* (2013.01)

(58) Field of Classification Search

CPC ..... D05B 75/00; D05B 75/08; D05B 75/22; D05B 75/24; D05B 75/26; D05B 75/38; H05B 1/00; F22B 35/00; F22B 35/18; F22B 27/00; F22B 27/04

USPC ..... 38/77.7–77.83, 93, 14, 77.1; 219/245, 219/248, 225, 227, 249, 257; 392/403–406

See application file for complete search history.

(56) References Cited

U.S. PATENT DOCUMENTS 3,612,069 A * 10/1971 Waters et al. ..... 132/212
4,658,520 A 4/1987 Henneberger (Continued)

FOREIGN PATENT DOCUMENTS

EP 0902117 B1 3/1999
FR 2764912 A1 12/1998

(Continued)

*Primary Examiner* — Ismael Izaguirre

(57) ABSTRACT

An iron (1), comprising: a water reservoir (10), configured to hold liquid water; a heatable soleplate (20), including at least one mist outlet opening (22); water atomization means (30), configured to atomize water from the water reservoir so as to generate a mist of water droplets at a mist generation site (32) mist distribution means (40), configured to distribute the mist from the mist generation site (32) to the at least one mist outlet opening (22), comprising: a distribution channel (42), extending from an air inlet (46), along the mist generation site (32), to the at least one mist outlet opening (22); and an air flow generator (44), disposed in or adjacent said distribution channel and configured to generate an airflow that transports the water droplets, from the mist generation site (32), through the distribution channel (42), to the at least one mist outlet opening (22).

11 Claims, 5 Drawing Sheets

(56) References Cited

U.S. PATENT DOCUMENTS

| | | | | |
|---|---|---|---|---|
| 5,799,422 | A | 9/1998 | Demuth | |
| 6,035,563 | A | 3/2000 | Hoefer et al. | |
| 6,216,369 | B1 | 4/2001 | Wolf | |
| 6,438,876 | B2 | 8/2002 | Har | |
| 7,093,384 | B2 * | 8/2006 | Wong et al. | 38/77.5 |
| 7,610,701 | B2 * | 11/2009 | Cavada | 38/82 |
| 8,091,257 | B2 * | 1/2012 | Aiura | 38/77.7 |
| 8,402,597 | B2 * | 3/2013 | Rosenzweig et al. | 15/339 |
| 2004/0026398 | A1 * | 2/2004 | Wehrwein et al. | 219/229 |
| 2004/0084433 | A1 * | 5/2004 | Field et al. | 219/221 |
| 2004/0096369 | A1 * | 5/2004 | Daoting | 422/124 |
| 2005/0005480 | A1 * | 1/2005 | Asvadi et al. | 38/77.7 |
| 2005/0069302 | A1 | 3/2005 | Wong et al. | |
| 2012/0319308 | A1 * | 12/2012 | Chen et al. | 261/28 |

FOREIGN PATENT DOCUMENTS

| | | | |
|---|---|---|---|
| JP | 5269299 | A | 10/1993 |
| JP | 2001113099 | A | 3/2004 |
| WO | 03052194 | A1 | 6/2003 |
| WO | 2004085732 | A1 | 10/2004 |

* cited by examiner

IRON FEATURING LIQUID PHASE GARMENT MOISTURIZATION

FIELD OF THE INVENTION

The present disclosure relates to the field of garment care irons, and more in particular to such irons featuring liquid phase moisturization means adapted to supply fine droplets of liquid water to a garment being ironed.

BACKGROUND OF THE INVENTION

Ironing may be described as the process of using an iron to remove wrinkles from a fabric, in particular a garment. During ironing, the fabric may preferably be heated to loosen the intermolecular bonds between the long-chain polymer molecules in the fibers of the fabric. In their loosened condition the weight of the iron may force the fibers in a wrinkle-free state. When the stress in the fibers is properly removed the wrinkle-free state of the fabric will be maintained upon cooling. The removal of stress in the fibers of the fabric is significantly enhanced by heating the fabric to above its glass transition temperature. For many natural fabrics, such as cotton, wool and linen, the glass transition temperature is dependent on the moisture content. The dependency is such that an increase in the moisture content or humidity lowers the transition temperature. A higher moisture content thus improves the degree of stress relaxation, and hence the ironing result at the same temperature. To achieve optimum ironing results, a moisture content of about 3-15% by weight of the fabric to be ironed is desired. The precise optimum percentage depends on the nature of the fabric, and may for example be relatively low for polyester while it is relatively high for natural materials such as cotton.

A fabric being ironed may be moisturized in different ways, such as through steam or liquid water. Steam may for example be released through steam outlet openings in a heated soleplate of the iron, and moisturize the fabric by subsequently condensing therein. A significant drawback of this approach is that steam is not a very efficient moisturizer: only a small fraction of the steam, typically on the order of several tens of percent, is used for moisturizing the fabric; the rest passes through it without condensing. As a result, steam irons are generally incapable of effecting the aforementioned optimum moisture content in the fabric.

It may therefore be advantageous to use an iron that employs liquid water to moisturize a fabric, such as the iron disclosed by U.S. Pat. No. 6,035,563 (Hoefer et al.). The soleplate of the disclosed iron is provided with at least one mist outlet opening, arranged in an area of the soleplate tip. The mist outlet opening allows a liquid stored in a liquid tank to pass through and moisten materials to be ironed. The liquid exits the opening in the form of liquid droplets that are generated using an atomizer device in the form of a piezo-electrically driven thin membrane plate disposed just above the soleplate.

Placement of a piezo-driven membrane just above the soleplate of an iron, as in U.S. '563, is generally prompted by the fact that such atomizers generate a rather local mist. As the water droplets of the mist are imparted with little momentum upon generation, the atomizer must be located close to the fabric being ironed, and thus close the soleplate of the iron. Unfortunately, positioning an atomizer adjacent the soleplate entails a number of drawbacks. Heat from the soleplate, for example, may interfere with its operation. At elevated temperatures the atomization rate may increase unintentionally, while the piezoelectric transducer may even be irreversibly damaged when it is accidentally heated to above its Curie temperature. Furthermore, heat from the soleplate may evaporate the mist that tends to linger around the atomizer even before its droplets reach the fabric being ironed, and consequently reduce the moisturization efficiency of the iron. Another drawback stems from the fact that a relatively large membrane area, plus potentially multiple piezoelectric transducers to drive it, may be required to achieve a sufficient and uniform water deposition rate across the soleplate area. These measures may amount to relatively high manufacturing costs and a lower degree of reliability due to the use of extra, typically delicate components.

It is an object of the present invention to provide for an iron that overcomes or alleviates one or more of these disadvantages associated with known liquid water moisturization irons.

SUMMARY OF THE INVENTION

According to a first aspect of the invention, there is provided an iron. The iron includes a water reservoir configured to hold liquid water, a soleplate including at least one mist outlet opening, and water atomization means configured to atomize water from the water reservoir so as to generate a mist of water droplets at a mist generation site. The iron further includes mist distribution means, configured to distribute the mist from the mist generation site to the at least one mist outlet opening. The mist distribution means include a distribution channel, extending from an air inlet, along the mist generation site, to the at least one mist outlet opening. They also include an air flow generator, disposed in or adjacent said distribution channel and configured to generate an airflow that transports the water droplets, from the mist generation site, through the distribution channel, to the at least one mist outlet opening.

In the iron according to the present invention the water atomization means need not be placed adjacent to the soleplate as it provides for a mist distribution system that is capable of transporting mist from an arbitrarily located mist generation site to the at least one mist outlet opening in the soleplate. The mist distribution system may include a distribution channel and an air flow generator, such as a fan or a pump. The air flow generator may be adapted to generate a pressure differential across the distribution channel in order to effectuate an air flow therein. The air flow may extend from an air inlet of the distribution channel, along, past or through the mist generation site, and to the at least one mist outlet opening in the soleplate of the iron. Accordingly, the air may serve as a transport medium for the water droplets generated by the water atomization means, and the air flow may be used to pick up the water droplets at the mist generation site for transport to the at least one mist outlet opening.

Placement of the water atomization means at a distance from the heatable soleplate, as enabled by the mist distribution system, may reduce exposure of the atomization means to the heat the soleplate may give off. The risk of unintentional interference with their operation or damage to their construction may thus be prevented. Furthermore, the air flow in which the water droplets are dispersed may act as a thermally insulating carrier that quickly transports them through the at least one mist outlet opening in the soleplate. Consequently, the water droplets may pass through the soleplate without being evaporated even before they contact a fabric being ironed. Another advantage resulting from the mist distribution system is that mist may be generated at one or another small number of mist generation sites, and be transported therefrom to a plurality of mist outlet openings together covering a desired portion of a bottom area of the soleplate. The necessity of the large area piezo-driven membranes may thus be overcome, while the freedom to design the iron may at the same time be increased.

In an embodiment of the iron according to the present invention, the water atomization means may comprise at least one piezoelectric fluid atomizer. A piezoelectric atomizer is generally cost-effective, may offer a fast response time and allow the rate of generation of water droplets to be controlled easily by varying the electric drive signal provided to it.

According to an elaboration of the present invention, the iron may include a housing. The housing may be connected to the soleplate of the iron and accommodate at least one of the water reservoir, the water atomization means and the air flow generator.

The housing of the iron is understood to be the part of the iron that, at its underside, is connected to the soleplate. That is to say, it is the part that is normally moved across a fabric being ironed. As such, the housing is to be distinguished from bodies external to the housing. Such external, typically stationary bodies are commonly found in so-called 'system irons', in which they may for example serve to accommodate a pressurized steam generator including a relatively large steam chamber. The term 'iron' as used in this text is to be construed as including both one-piece hand irons and two-piece ironing system. The iron according to the present invention may thus comprise an external body that accommodates the water reservoir, the water atomization means and/or the airflow generator. Such an iron will be exemplified below. In a preferred embodiment, however, the movable housing of the iron includes at least one of the water reservoir, the water atomization means, the mist generation site and the air flow generator so as to create an economically manufacturable, compact and attractive iron. In case all said elements are integrated into the housing of the iron, the distribution channel through which the mist is to be transported may be relatively short. This may have an advantageous effect on the load on the air flow generator (a shorter distribution channel induces less drag on the air flow), the risk of water droplets coalescing in the distribution channel, and the responsiveness of the mist outflow rate of the iron to changes in the drive signals applied to the water atomization means and the air flow generator.

The proper transport of water droplets through the distribution channel is dependent on the successful interplay between the water atomization means and the distribution means. In this respect several factors may need to be taken into account, among which the size of the water droplets and the air flow rate.

The size of the water droplets to be transported through the distribution channel is a measure for their mass, and hence for their inertia. Due to their inertia, large water droplets may be unfit to be maneuvered through the distribution channel by means of the air stream, in particular without substantial risk of wall collisions and subsequent pool forming or aggregation. For this reason, the atomization means may be configured to generate water droplets having an average diameter in the range 3-20 μm, more preferably 4-10 μm. In addition, the distribution of the droplet sizes may be relatively small, such that less than 20% of the droplets have a diameter above 25 μm, and more preferably 15 μm.

The air flow rate required to transport the generated mist may preferably be such that the mist can easily negotiate any bends and restrictions in the distribution channel. In general a mist having a greater water density, either because of a larger number of water droplets per unit of volume or larger droplets, may require a greater air flow rate. For most practical purposes a volumetric air flow rate of 5-200 liters/min, at a pressure differential across the distribution channel in the range of $10\text{-}1\cdot10^3$ Pa, may suffice. In a preferred embodiment, the air flow generator may be configured to generate an air flow having an air flow rate in the range of 15-100 liters/min at a driving pressure in the range of 20-250 Pa relative to the ambient.

According to an elaboration of the invention, the iron may include control means configured to exert control over the operation of at least one of the water atomization means and the air flow generator. In one embodiment, the iron may also include a soleplate temperature sensor, configured to generate a reference signal comprising information about a temperature of the soleplate, and the control means, which may be operably connected to the soleplate temperature sensor, may be configured to control a rate of mist generation by the water atomization means in dependence said reference signal. In another embodiment, the control means may be configured to control the air flow generator and the water atomization means in mutual dependence, such that a mist having a higher water density is transported by an air flow having a higher air flow rate, and/or vice versa. In yet another embodiment, the soleplate may comprise a plurality of mist outlet openings, said mist outlet openings being divided into a plurality of groups, wherein each group is associated with at least one of dedicated water atomization means and/or a dedicated air flow generator, such that a mist outflow rate of said groups may be controlled independently of one another by the control means, configured to control the dedicated air flow generators and/or the dedicated water atomization means.

In one embodiment of the iron according to the present invention, a flow laminizer may be disposed within the distribution channel. The flow laminizer may preferably be disposed downstream of the air flow generator, and upstream of the mist generation site.

The transport of mist in the present iron, as opposed to the transport of water vapor used in steam irons, places special demands on the distribution means. While transporting water vapor, for example, a primary concern may be to prevent cooling and subsequent condensation of the vapor within the transport channel. During mist transport, condensation is not a main concern. Instead, a mist distribution system may call for measures to prevent the water droplets from coalescing or aggregating into larger droplets that cannot be properly distributed by the present air flow, an issue that is unfamiliar to steam irons. To this end a flow laminizer may be provided in the distribution channel. The flow laminizer may preferably be disposed downstream of the air flow generator, e.g. a fan or pump, and upstream of the mist generation site. In such a case any turbulence in the air flow generated by the air flow generator is smoothened out before the air flow picks up the water droplets. This precludes the water droplets from unnecessarily being smashed against each other or the walls of the distribution channel, which might result in their coalescence.

According to an elaboration of the iron according to the present invention, a cross-sectional area of the distribution channel, seen in a downstream direction from the water atomization means, or if present from an air flow laminizer disposed upstream of the water atomization means, either remains substantially the same or decreases.

Experiments have revealed that widening the distribution channel downstream of the water atomization means, or if present an air flow laminizer disposed upstream thereof, is disadvantageous as increases in a cross-sectional area of the distribution channel may negatively affect the laminar characteristics of an air flow and even induce turbulence. To prevent this, the cross-sectional area of a distribution channel may preferably be monotonically decreasing downstream of the water atomization means or the air flow laminizer, as the case may be.

In an embodiment of the iron according to the present invention, a lower wall portion of the distribution channel may include a water accumulator, configured to gravitationally trap liquid water travelling over said wall portion. The water accumulator may essentially be a gravitational potential well, which may be formed as a pit, recess, wall-enclosed basin, blind-ended branch of the distribution channel or the like. It may be accessible through an opening in a lower wall portion of that channel, or at least be provided such that the air stream transporting mist droplets may pass over it. The water accumulator may function as a gravitational trap for aggregate water droplets that are not airborne, but instead travel by rolling along the wall of the distribution channel. In an especially advantageous embodiment, the water accumulator may be thermally connected to the soleplate or another heating means, so as to facilitate the evaporation of liquid water trapped in the water accumulator in order to empty it.

In a preferred embodiment of the iron according to the present invention, a groove may be provided in or on an underside of the soleplate. The groove may extend from the at least one mist outlet opening provided therein.

When, during ironing, the soleplate of the iron is in contact with a fabric being ironed the mist outlet openings therein may be wholly or partly blocked by the fabric. As a result, the mist released from the mist outlet openings may be forced into and through the fabric for moisturizing it. Although in itself this may be a desired effect, the blocking of the mist outlet openings also introduces a considerable flow restriction. This flow restriction may hamper the air flow through the distribution channel upstream of mist outlet openings and effectively cause the air flow rate through the distribution channel to drop at a same power setting of the air flow generator, compared to the situation of unobstructed mist outlet openings (e.g. a free-hanging iron). As a certain minimum air flow rate is required to properly transport mist through the distribution channel, it may be necessary to compensate for the flow restriction near the outlet openings, in particular by increasing the power to the air flow generator. This solution is less preferred as it places higher demands on the construction of the air flow generator (causing it to be more expensive), and it may both increase the power consumption and the noise production of the iron. To avoid these disadvantages, one or more mist outlet openings in the soleplate may be associated with one or more grooves. A groove may be provided in an external or underside of the soleplate and extend from an associated mist outlet opening. The grooves serve to increase the effective area of the mist outlet opening and to thereby decrease the overall flow resistance.

According to an elaboration of the invention, the groove may extend from the at least one mist outlet opening to a circumferential edge of the soleplate.

By having a groove extend all the way to the circumferential edge or side of the soleplate, such that the downstream end of the groove discharges into the atmosphere next to/surrounding the iron, the air released from the mist outlet openings is allowed to flow sideways and escape from under the iron without having to pass through a fabric being ironed. It has been shown in theory and experiment that this considerably reduces the flow resistance at the mist outlet openings. The geometry of the mist outlet openings and grooves may be chosen such that the water droplets that are carried along by the air flow are unable to follow the air flow, and are deposited onto the fabric being ironed. Examples of such geometries will be discussed in more detail below.

Under specific circumstances, the grooves may not be able to decrease the overall flow resistance experienced by the air flow exiting the mist outlet openings. This may, for example, be the case when the iron is pressed onto a fabric being ironed with so much force that the fabric is forced into the grooves and blocks them. To prevent a stagnation of the air flow through the distribution channel in cases like this, the distribution channel may be fitted with a pressure relief exit, preferably disposed downstream of the air flow generator, through which an air flow can escape the iron when the at least one mist outlet opening is substantially blocked. The pressure relief exit may be valved, but need not be. It may preferably take the form of a small opening or slit in a side wall of the distribution channel that, possibly via a small relief channel, provides an exit into the surrounding atmosphere of the iron. A relief channel may preferably have dimensions comparable to those of the grooves, discussed below. In one embodiment, the pressure relief exit may be provided at an end of the distribution channel, just upstream of a mist outlet opening in the soleplate: by freely suspending the downstream end of the distribution channel in the mist outlet opening, the distribution channel is effectively provided with a circumferential pressure relief exit. This exit cannot be blocked by closing the mist outlet openings. At the same time, a mist carrying flow will only be forced out through the pressure relief exit when the mist outlet opening is blocked after all, the flow will normally simply pass by the exit as its momentum is directed substantially parallel to distribution channel instead of in a radial direction thereof.

During ironing, the iron according to the present invention deposits water in the liquid phase onto the fabric being ironed. This fact may be used advantageously by adding water-soluble functional additives (e.g. artificial odours, wrinkle prevention and/or stain resistance substances) to the water in the water reservoir, which additives are then carried along by the water droplets, until they are released from the mist outlet openings in the soleplate of the iron and deposited onto the fabric. The integration of the additive application and the moisturization functions of the iron renders a separate additive spray system superfluous. Furthermore, the integration ensures that the additives are applied to portions of the fabric actually being ironed. This is in contrast to some known spray systems featuring a nozzle, mounted on the nose of the iron, that must be aimed at a spot in front of or next to the iron onto which the additive solution is to be sprayed. Known spray system may also suffer from the drawback that it may be hard to dose the additive solution precisely, and to apply the solution evenly to the fabric. The aforementioned integration overcomes these problems. The integration may be effected in different ways.

On a use level, a user may add an additive to the water in the water reservoir. This approach, however, does not allow for selectively switching the use of the added additives on or off, or for changing the dosage/concentration of the additive. These drawbacks may be overcome by additional features on a hardware level. The iron may, for example, be fitted with a separate possibly detachable or disposable additive reservoir, configured to hold an additive or additive solution, and with a controllable additive dosing valve, configured to selectively bring the additive reservoir in fluid communication with the water atomization means. The additive dosing valve, which may be under the control of the control means, may allow the additive reservoir to be coupled to (an upstream side of) the water atomization means, either exclusively or together with the water reservoir. In the former case only additive solution may be atomized. In the latter case additive solution from the additive reservoir and water from the water reservoir may be mixed upstream of the water atomization means, such that atomization of a mixture of both may take place.

The molecular weight of any additive to be used with the iron may preferably be below 250,000 g/mole, and more preferably below 50,000 g/mole. The reason for this is that a relatively large molecular weight may hamper the droplet formation during atomization. A permanent or temporary wrinkle resistance may be induced by using non-formaldehyde based cross linkers and softeners using trimethylol melamine derivates, phosphinicosuccinic acid and its derivatives, poly-carboxulic acids, isocyanates and cationic surfactants. Water repellent additives such as organo fluoro compounds may be used to reduce the interaction of the garment with water, and to increase stain resistance. Furthermore, odour control additives based on amine containing polymers, and UV-protection additives based on UV-light absorbing quaternary polysiloxanes may also be used. The concentration of any of these additives in the deposited liquid droplets may preferably be in the range of 0.001-50% bw, and more preferably 0.5-20% bw.

Another aspect of the present invention is directed to a method of ironing a fabric. The method includes providing an iron according to the present invention; providing a fabric to be ironed, and ironing said fabric using said iron. In an embodiment, the method may also include ironing with said iron while its water reservoir is at least partly filled with water to which at least one functional additive has been added.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1:
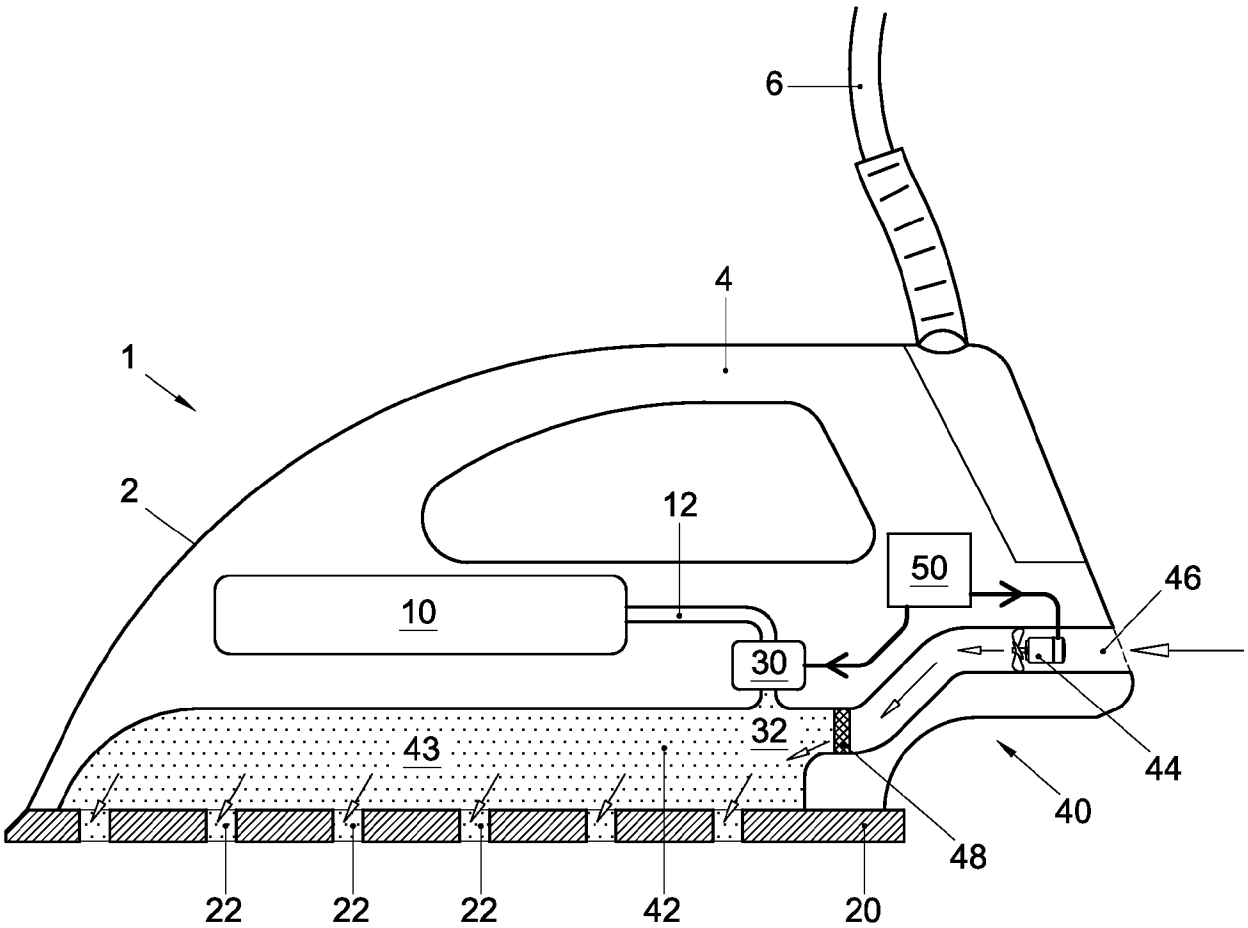
FIG. 1 schematically illustrates, in a side view, a first exemplary embodiment of the iron according to the present invention.
Figure 2A:
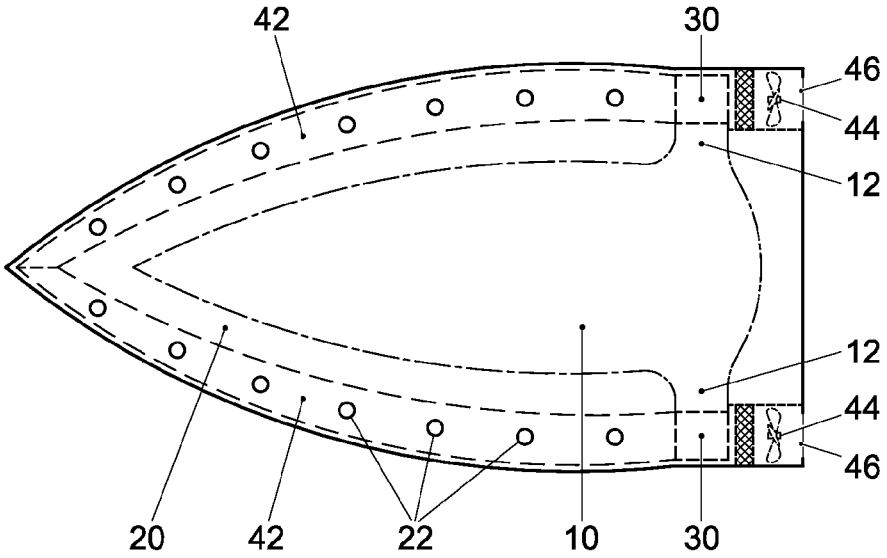
FIG. 2 are schematic bottom views of a second (FIG. 2*a*) and third (FIG. 2*b*) embodiment of the iron according to the present invention.
Figure 2B:
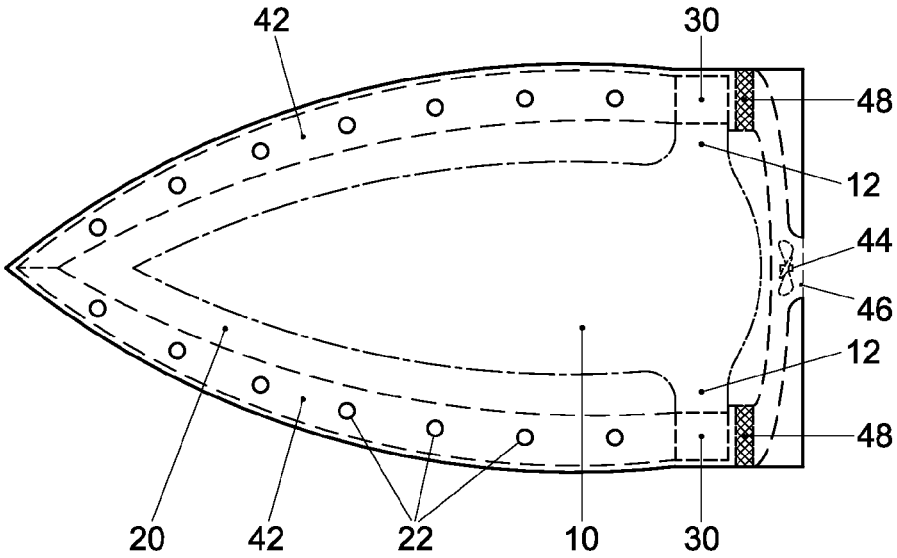
Figure 3:
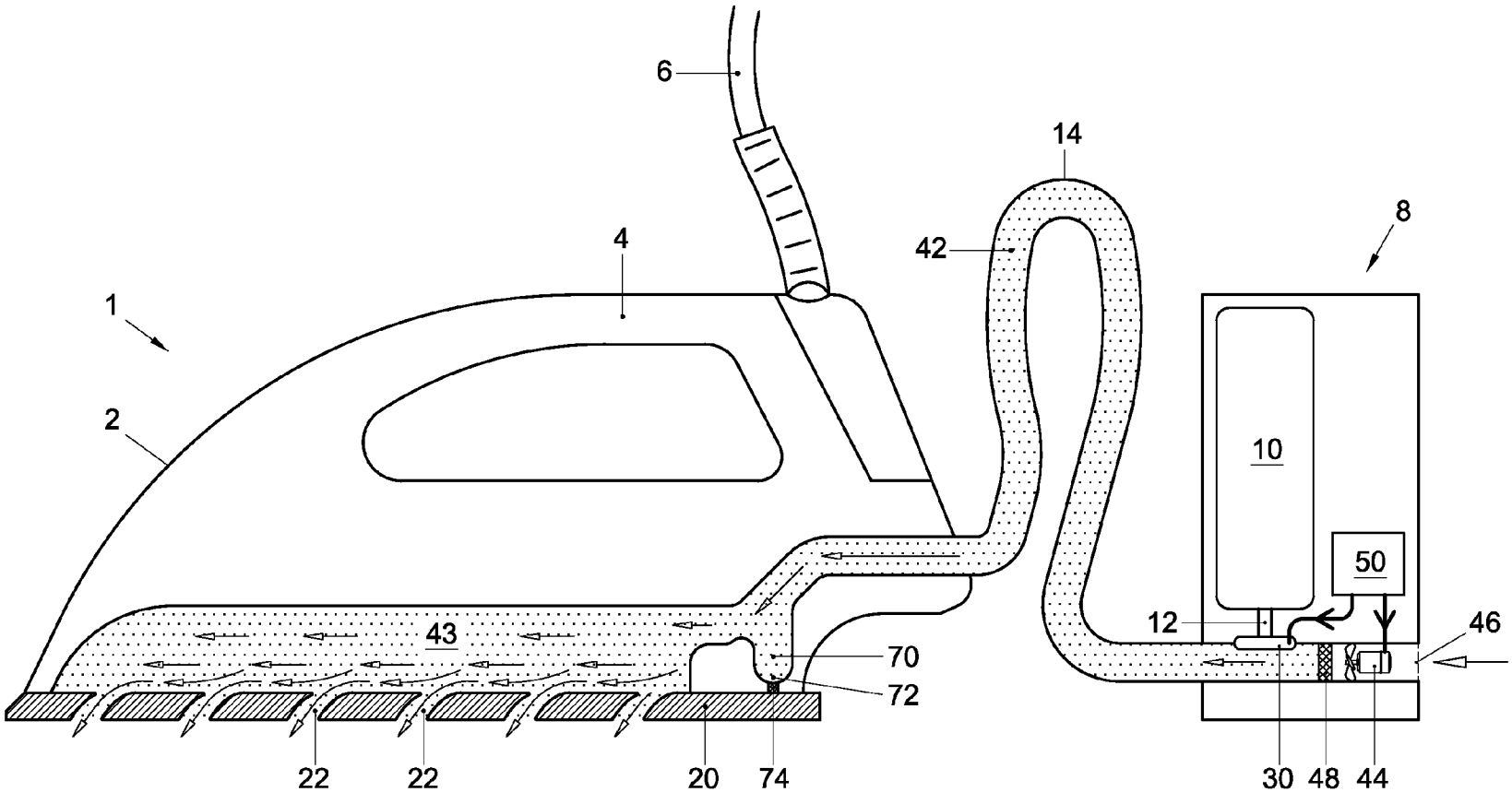
FIG. 3 schematically illustrates, in a side view, a fourth exemplary embodiment of the iron according to the present invention.

FIG. 1 schematically illustrates a first exemplary embodiment of the iron 1 according to the present invention. FIG. 2 are schematic bottom views of a second (FIG. 2*a*) and a third (FIG. 2*b*) embodiment of the iron according to the present invention, and FIG. 3 schematically illustrates a fourth exemplary embodiment of the iron according to the present invention. Referring now to FIGS. 1-3, the construction of the iron according to the present invention will be briefly elaborated upon in general terms.

The iron 1 may comprise a housing 2, which in itself may be of a substantially conventional design. The housing 2 may have a power cord 6 connected thereto to supply any electronics inside the housing with electric power. On its upper side, the housing may be provided with a handle 4, while on its bottom side it may be connected to a soleplate 20.

In one embodiment, the soleplate 20 may include one or more mist outlet openings 22 for releasing water therefrom during ironing. This terminology aims to include embodiments wherein the mist outlet openings 22 are disposed immediately adjacent to the soleplate 20, e.g. around a circumferential edge thereof. The mist outlet openings 22 may in principle be disposed in any desired pattern or configuration, while each mist outlet opening may have any suitable cross-sectional shape, e.g. circular, elliptical, etc. Preferred shapes of the mist outlet openings 22, and more in particular grooves that may be associated therewith, are discussed below with reference to FIGS. 4-6. A mist outlet opening 22 may extend in a direction perpendicular to the plane of the soleplate 20 for easy manufacturability. See for example FIG. 1. Alternatively, a mist outlet opening 22 may be slightly curved and/or arranged to extend at a non-perpendicular angle to the plane of the soleplate 20, preferably such that its general direction has a positive component in the direction of a mist flow at the influx end of the outlet opening, so as to enable a smooth flow of the mist into said outlet opening. See for example FIG. 3. The soleplate 20 may be heatable through heating means (not shown), so as to enable it to give off heat during ironing for evaporating any released water. One skilled in the art will appreciate that a wide variety of heating means may be applied for the purpose of heating the soleplate 20. Heating means may, for example, include one or more electric heating elements, such as electric resistors. In one embodiment, such electric resistors may be printed on the soleplate 20 to provide for so-called 'flat heating'. In an alternative embodiment, the heating means may be configured to heat the soleplate 20 via inductive heating, or via hot air streams led alongside or through channels in the soleplate. In any case, the heating means may preferably be arranged such that the soleplate 20 is substantially uniformly heatable, in particular between the mist outlet openings 22.

The iron 1 may include a water reservoir 10 configured to hold the liquid water that is to be released through the mist outlet openings 22 in the soleplate 20. In one embodiment of the iron, a housing 2 thereof may accommodate the water reservoir 10, as shown in FIG. 1. In an alternative embodiment the water reservoir 10 may be disposed outside of the iron housing 2, such as in an external stationary body 8 (see FIG. 3) that may be placed next to an ironing board. An advantage of such an external water reservoir 10 is that it may typically have a larger storage capacity than an internal reservoir accommodated inside the housing 2. At the same time, it may offer reduced weight for, and thus improved handling of, the movable iron housing 2.

A water channel 12 may connect the water reservoir 10 to water atomization means 30. The water atomization means 30 may be configured to atomize water from the water reservoir 10 in order to generate a mist of water droplets, having an average diameter in the range of 1-50 μm, at a mist generation site 32. The mist generation site 32 may preferably be located in or adjacent to a distribution channel 42, to be discussed hereafter. In the embodiment of FIGS. 1 and 3 only one set of water atomization means 30 is provided; the mist they produce is transported to and distributed over all mist outlet openings 22 of the iron. In the embodiments of FIG. 2, two sets of water atomization means 30 are provided, each dedicated to a selected number or group of mist outlet openings 22. As each set of water atomization means 30 may be controlled independently, such a setup enables independent control over the mist release behavior of different (groups of) mist openings 22.

The atomization means 30 may take different forms. In one embodiment, they may for example include a piezoelectric fluid atomizer, such as a piezo driven perforated membrane, a piezo driven piston that forces water through a perforated membrane or a resonant cavity, which consists of a housing containing a piezo ceramic material, a water layer and a perforated membrane. The rate of generation of water droplets may then be controlled by varying the electric drive signal provided to the piezoelectric atomizer. Piezo atomizers generally offer the advantage of a fast response time. Alternatively, the water atomization means may take the form of a narrow orifice through which water may be forced at high pressure using an electric pump (not shown). In this case, the rate of generation of water droplets may be controlled by varying the drive signal supplied to the pump. In general, any of the following properties of the drive signal may be varied to control the operation of the atomization means: the amplitude/voltage, the frequency and the duty cycle.

The iron 1 may also include a distribution channel 42. The distribution channel 42 may generally extend from an air inlet 46 to the at least one mist outlet opening 22 in the soleplate 20. Both at the air inlet 46 and at the mist outlet openings 22 the distribution channel 42 may be in fluid communication with the environmental atmosphere of the iron 1.

To prevent unnecessary aggregation of water in the distribution channel 42, the distribution channel may preferably be bound by one or more smooth walls that interfere as little as possible with an air flow through it. Furthermore, on the one hand, the temperature inside the distribution channel 42 during ironing may preferably not be too high, so as to prevent mist droplets from being evaporated during their transport. To this end, the distribution channel 42 may, at least over a portion of its length, be provided with a thermal insulation that shields the interior of the channel 42 from heat that may emanate from the soleplate 20. The distribution channel 42 may, for example, be constructed from a heat resistant, low-thermal-conductivity plastic, such as Ryton™, that is capable of withstanding temperatures of up to about 350° C. On the other hand, the wall of the distribution channel 42 may include portions that are heated to a sufficient temperature to evaporate aggregate water droplets that glide or roll over it. This may prevent these droplets from reaching the mist outlet openings 22, where they might otherwise induce undesired dripping and/or violent spitting behavior. For example, in one embodiment a portion of the distribution channel 42 may be integrated with, i.e. extend immediately adjacent or through, the soleplate 20. An alternative solution is illustrated in the embodiment of FIG. 3, which features a water accumulator 70. The water accumulator 70 may for example be formed as a pit, recess, wall-enclosed basin or blind-ended branch of the distribution channel 42, and may be accessible through an opening in a lower wall portion of that channel, or at least be provided such that the air stream transporting mist droplets may pass over it. The water accumulator 70 may function as a gravitational trap for aggregate water droplets that are not airborne, but instead travel by rolling along the wall of the distribution channel 42. The water accumulator 70 may have sloping bottom portions that guide the trapped water to a lowest point. The bottom wall portions, and in particular the lowest bottom wall point of the accumulator 70, may be heated, e.g. through a thermal connection to the heated soleplate 20 by means of a thermally conductive element 74, so as to form a thermal hot spot 72 for evaporating any accumulated water. Although the water accumulator 70 is illustrated with respect to a two-piece or system iron as shown in FIG. 2, it is understood that it may equally well be implemented in a one-piece iron as shown in FIG. 1.

In addition, the distribution channel 42 may preferably be relatively short, e.g. on the order of the characteristic dimensions of the iron housing 2, since a longer channel may generally increase both the chance of coalescence of water droplets and the response time required to effect changes in the mist output at the mist outlet openings 22 (drive signals that determine the mist output may be applied to the water atomization means 30 and/or the air flow generator 44, both of which may typically be located further upstream of the mist outlet opening(s) 22 with increasing distribution channel length). Also, to prevent adverse effects on the laminarity of the air flow, the cross-sectional area of the distribution channel 42 may preferably be monotonically decreasing in the flow direction, from the mist generation site 32 or an air flow laminizer 48 onwards. In a practical embodiment, the cross-sectional area may for example start out in the range of 10-1500 $mm^2$ and gradually decrease downstream of the mist generation site 32.

In the embodiments of FIGS. 1-2, the distribution channel 42 is accommodated by the housing 2. In the embodiment of FIG. 3, the distribution channel 42 extends from an air inlet 46 provided in the external body 8, via a mist hose 14 that interconnects the external body 8 and the housing 2, to the mist outlet openings 22 in the soleplate 20 of the iron. The embodiments of FIG. 2 differ from those shown in FIGS. 1 and 3 in that they comprise two distribution channels 42, each of which is associated with a selected number or group of mist outlet openings 22 disposed along a respective longitudinal edge of the soleplate 22.

In some embodiments, see for example FIGS. 1 and 3, a portion of the distribution channel 42 may form a homogenization chamber 43. Such a homogenization chamber 43 may be a relatively voluminous portion of the distribution channel 42, including the mist generation site 32 or being disposed at a point downstream thereof. During use, the homogenization chamber 43 may be subjected to a pressure drop (in the flow direction of the mist) that is relatively small compared to the pressure drop required to force the mist through the fabric being ironed. By setting an appropriate pressure drop across the homogenization chamber 43, the length of stay of mist within the chamber may be adapted to be such that the mist is allowed to distribute itself substantially homogeneously throughout the chamber. The homogenization chamber 43 may be connected to one or more mist outlet openings 22. It is understood that a homogenous distribution of mist within the homogenization chamber 43 will result in a homogeneous release of mist via each of the mist outlet openings 22 connected thereto. The embodiments depicted in FIGS. 2A and 2B do not include a homogenization chamber. Instead, their distribution channels 42 monotonically decrease in cross-sectional area downstream of the water atomization means 30, so as to prevent any adverse effects on the laminarity of the air flow that may result from widening the distribution channel 42 as in the case of the homogenization chamber 43.

In or adjacent the distribution channel 42 an air flow generator 44 may be provided. The air flow generator 44 may be configured to generate an air flow through the distribution channel 42, said air flow being directed from the air inlet 46 to the mist outlet openings 22 in or adjacent the soleplate 20. The air flow generator 44 may be of a conventional design and for example include an (electric) fluid pump or a fan. Relative to an electric fan, an electric fluid pump may typically be rather bulky and noisy. Furthermore, an electric fan may typically be more efficient at providing high flow rates at low operating pressures. For these reasons, an electric fan is preferred to an electric pump. For most practical purposes, an air flow generator 44 capable of producing an air flow having a volumetric air flow rate of 5-200 liters/min, at an operating pressure the range of $10\text{-}1\cdot10^3$ Pa, may suffice to efficiently transport a fine mist through the distribution channel 42. In a preferred embodiment, the air flow generator may be configured to generate an air flow having an air flow rate in the range of 15-100 liters/min at an operating pressure in the range of 20-250 Pa. The air flow generator 44 may preferably be located upstream of a mist generation site 32 in order to prevent it from unnecessarily introducing turbulence in the mist being transported. As mentioned, in the embodiments of FIG. 2 two distribution channels 42 are present. In FIG. 2*a* each of these distribution channels 42 is associated with its own air flow generator 44, while in FIG. 2*b* an air flow generator 44 is shared between the channels 42 to provide for a more cost-effective design.

A flow laminizer 48 may be disposed within the distribution channel 42. The flow laminizer 48 may preferably be disposed downstream of the air flow generator 44, and upstream of the mist generation site 32. In such a case any turbulence in the air flow generated by the air flow generator 44 is smoothed out before it picks up the water droplets. This precludes the water droplets from unnecessarily being smashed against each other or the walls of the distribution channel 42, which might result in their coalescence. The flow laminizer 48 may take different forms, and for example include an open cell foam comprising a network of interconnected pores through which the air flow may be driven to smooth out any turbulence. Alternatively, the flow laminizer 48 may be implemented as a channel structure, comprising substantially parallel channels through which the air may be driven. In yet another embodiment, the flow laminizer 48 may include a knitted mesh, such as a stainless steel mesh. The diameter of the pores or channels of the flow laminizer may be in the range of 0.01 and 10 mm, preferably 0.3-3 mm, while in principle, it may be made of any suitable material including, for example, metal, plastic and ceramics. The length of the flow laminizer 48 in the flow direction may be in the range of 1-100 mm and more preferably in the range of 5-30 mm.

The iron 1 may further include (electronic) control means 50. The control means 50 may comprise an integrated circuit, such as a CPU, that runs a control program for coherently controlling the components subjected to its supervision. These supervised components may include the water atomization means 30, the air flow generator 44 and the heating means (not shown). The control means 50 may exercise control over these components in dependence of signals that are received from one or more sensors, such as a soleplate temperature sensor.

In one embodiment, the control means 50 may for example be configured to control the rate of mist generation by the water atomization means 30 in dependence of the soleplate temperature, which temperature may be reflected by a reference signal generated by a soleplate temperature sensor. Generally, the control means 50 may be configured such that a greater soleplate temperature is associated with a greater rate of mist generation. Mist may for example be generated at a rate of about 0-5 grams/minute for low soleplate temperatures (e.g. 1 dot on the temperature dial), at a rate of 5-10 grams/minute for medium soleplate temperatures (e.g. 2 dots on the temperature dial), and at a rate of 10-20 grams/minute for high soleplate temperatures (e.g. 3 dots on the temperature dial). Having the control means respond to the actual/measured soleplate temperature instead of a user temperature setting prevents mist generation at too high a rate when the soleplate has a temperature that lies below the set temperature target value, in which case wet spots might result.

In another embodiment, the control means 50 may control the air flow rate of the air flow generated by the air flow generator 40 in dependence of characteristics of the mist generated by the water atomization means 30, such as the number, size/mass, velocity and direction of the water droplets thereof. For example, a mist having a greater water density, either because of a larger number of water droplets per unit of volume or larger droplets, may require are greater air flow rate to properly steer it through the distribution channel 42. Likewise, the higher the speed of the generated water droplets and/or the larger the angle between the direction of the air flow and the direction of the velocity of the generated water droplets, the larger the air flow rate needed to guide the droplets in the desired direction without hitting the walls of the distribution channel 42, so as to prevent unintentional coalescence of the droplets.

The general operation of the iron according to the present invention will now be described with reference to the embodiment of FIG. 1. During ironing, water is supplied from the water reservoir 10 to the water atomization means 30, which in turn generate a mist of water droplets at a mist generation site 32 located in the distribution channel 42. Within the distribution channel 42, an air flow maintained by the air flow generator 44 flows from the air inlet 46 to the mist outlet openings 22 in the soleplate. Any turbulence in the air flow is smoothed out by the flow laminizer 48 before it reaches the mist generation site 32. At the mist generation site 32, the air flow picks up the water droplets and transports them in the form of mist on into the homogenization chamber 43. There the mist is briefly given time to spread and form a substantially homogenous distribution, before being released from the mist outlet openings 22 in the soleplate 20.

Now that the basic construction and operation of the iron 1 according to the present invention has been described in some detail, attention is invited to a further aspect thereof.

Figure 4:
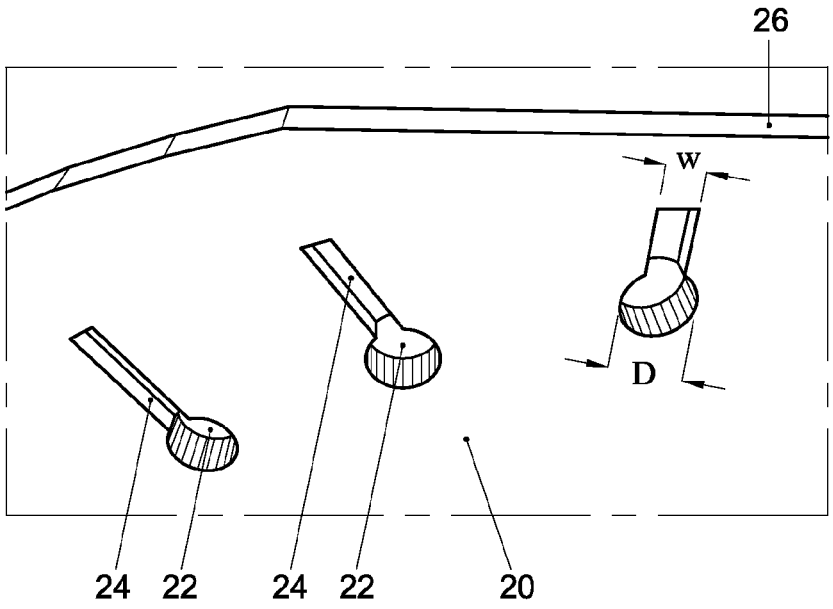
FIG. 4 is a schematic perspective view of a bottom side of a soleplate, including mist outlet openings associated with grooves that terminate before reaching the circumferential edge of the soleplate.
Figure 5:
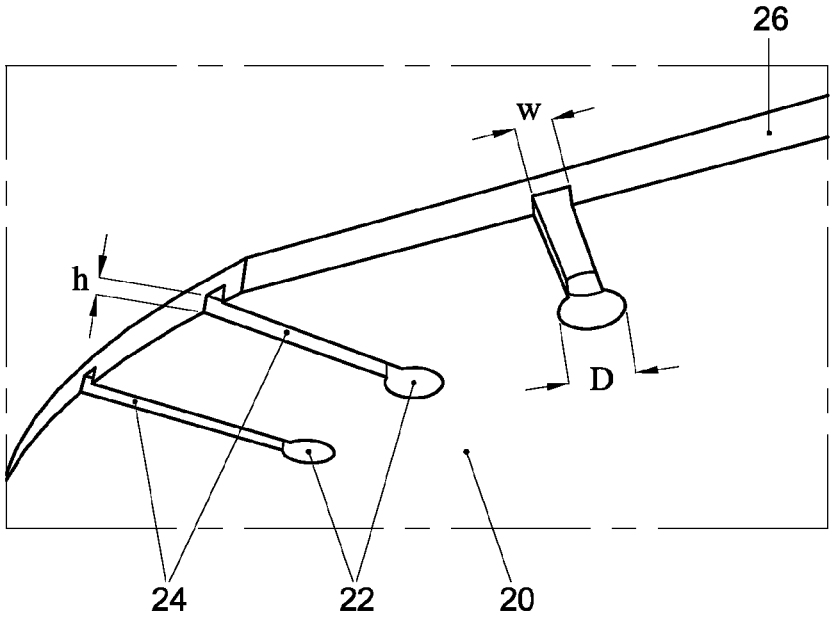
FIG. 5. is a schematic perspective view of a bottom side of a soleplate including mist outlet openings associated with grooves that extend up to a circumferential edge of the soleplate.

FIGS. 4 and 5 schematically illustrate a portion of a bottom side of a soleplate 20, including a number of mist outlet openings 22. Each of the mist outlet openings 22 is associated with a groove 24 that is provided in the underside of the soleplate 20 and that extends from the respective mist outlet opening 22. The grooves 24 in the embodiment of FIG. 4 terminate before reaching a circumferential edge 26 of the soleplate. They serve in particular to increase the area of the mist outlet openings 22 via which the air flow is forced through a fabric being ironed, and to lower the flow resistance accordingly. In the embodiment of FIG. 5 the grooves 24 extend up to the circumferential edge 26 of the soleplate 20. These latter grooves 24 thus allow the air to escape from under the soleplate 20 under nearly all circumstances, which is particularly favorable when the fabric being ironed is rather dense. The grooves 24 may preferably be formed as depressions in an otherwise flat underside of the soleplate 20, as depicted in FIGS. 4 and 5. It is contemplated, however, that in some embodiments, the grooves 24 may be defined by small protrusions that project from the otherwise flat underside of the soleplate 20 to form the grooves between them. In either latter case, the grooves 24 may form singular, independent channels (e.g. one channel per mist outlet opening) or a network of interconnected channels having exits to the circumferential edge 26 of the soleplate 20. With regard to the embodiment of FIG. 5, it has already been mentioned that the geometry of the mist outlet openings 22 and grooves 24 may be chosen such that the water droplets that are carried along by the air flow are unable to follow the air flow, and are deposited onto the fabric being ironed. The intended effect is illustrated in FIG. 6.

Figure 6:
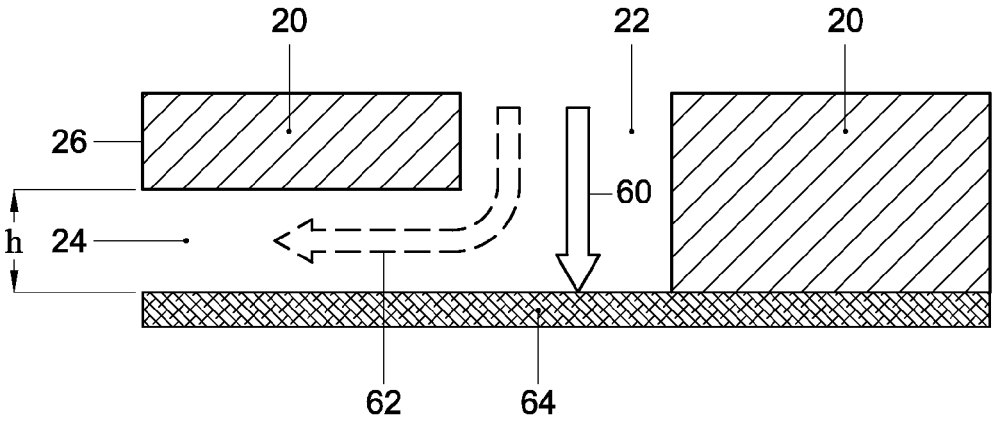
FIG. 6 is a schematic side view of a mist outlet opening of the soleplate shown in FIG. 5, illustrating the separation of flows of air and water droplets.

FIG. 6 is a schematic side view of a mist outlet opening 22 as shown in FIG. 5. The soleplate 20 in which the opening 22 is provided is placed in contact with a dense fabric 64 that is being ironed, and an air flow carrying water droplets is released from the mist outlet opening 22. It will be clear that the air flow is capable of escaping from under the soleplate 20, without passing through the fabric 64, by following the groove 24 that leads to the circumferential edge 26 of the soleplate 20. The groove 24 connects to the mist outlet opening 22 at a right angle (i.e. the angle between the longitudinal direction of the groove 24 and the longitudinal direction of the mist outlet opening 22 is approximately 90 degrees). Due to their momentum, the water droplets in the air flow may fail to make the 90-degree turn. This may cause the water droplets to separate themselves from the carrying air flow, forming a stream of water droplets 60 that deposits itself onto the fabric 64 being ironed. An air flow 62 free of water droplets may continue its way to the environmental atmosphere.

Whether water droplets having a certain mass are able to make the turn or not depends on the height or depth h of the groove 24. The height h determines the radius of the bend that each water droplet must negotiate successfully not to be thrown out of the air flow due to the centrifugal effect. In order to effectuate a maximum moisturization efficiency, the height h may preferably be chosen such that no droplets can make it to the environmental atmosphere. For this reason, the groove height/depth h is preferably in the range of 0.1 to 15 mm, and more preferably in the range of 0.5 and 2 mm.

With an eye to reducing the flow restriction near the mist outlet opening 22, a width w of groove 24 (see FIGS. 4 and 5) may preferably not be too small. In a preferred embodiment, the groove width w may be in the range of 0.8-28 mm, more preferably 2-8 mm, while a cross-sectional area of the grooves (i.e. h*w) may be in the range of $1\cdot10^{-6}$-$1\cdot10^{-3}$ $m^2$, more preferably $1\cdot10^{-5}$-$3\cdot10^{-4}$ $m^2$. For the same reason, the diameter D of a mist outlet opening 22 may preferably be in the range of 1-30 mm, more preferably 3-10 mm. The groove 24 may have any suitable length. For most practical purposes, the total number of mist outlet openings 22 in the soleplate may preferably in the range of 6-10.000, more preferably 16-60, while their combined outflow area is in the range of $1\cdot10^{-4}$-$1\cdot10^{-2}$ $m^2$, respectively $5\cdot10^{-4}$-$3\cdot10^{-3}$ $m^2$.

In FIGS. 4 and 5, the groove width w is each time depicted as being smaller than the mist outlet opening diameter D; this is not required however. Likewise, each mist outlet opening 22 in FIGS. 4 and 5 has been provided with merely one groove 24. In other embodiments, one or more mist outlet openings 24 may be provided with more than one groove 24. Furthermore, the illustrated grooves 24 all have a rectangular cross-section. Although this facilitates their manufacture through for example machining, a groove may in principle have any suitable cross-section, e.g. a truncated circular shape.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

LIST OF ELEMENTS

1 iron
2 iron housing
4 handle
6 power cord
8 external body
10 water reservoir
12 water channel
14 mist hose
20 soleplate
22 mist outlet opening in soleplate
24 groove
26 circumferential edge of soleplate
30 water atomization means
32 mist generation site
40 distribution means
42 distribution channel
43 homogenization chamber
44 air flow generator
46 air inlet
48 flow laminizer
50 control means
60 water droplet stream
62 air stream
64 fabric being ironed
70 water accumulator
72 hot spot
74 thermally conductive element
D diameter of mist outlet opening
w width of groove
h height of groove

The invention claimed is:

1. An iron, comprising:
a water reservoir, configured to hold liquid water;
a soleplate, including at least one mist outlet opening;
water atomization means, including a piezoelectric fluid atomizer configured to atomize water from the water reservoir so as to generate a mist of water droplets at a mist generation site
characterized in that the iron further comprises:
mist distribution means, configured to distribute the mist from the mist generation site to the at least one mist outlet opening, said mist distribution means comprising:
a distribution channel, extending from an air inlet, via the mist generation site, to the at least one mist outlet opening; and
an air flow generator, disposed in or adjacent said distribution channel and configured to generate an airflow that transports the mist, from the mist generation site, through the distribution channel, to the at least one mist outlet opening,
wherein a cross-sectional area of the distribution channel, seen in a downstream direction from the water atomization means, or —if present—from an air flow laminizer disposed upstream of the water atomization means, decreases monotonically.

2. An iron, comprising:
a water reservoir, configured to hold liquid water;
a soleplate, including at least one mist outlet opening;

water atomization means, including a piezoelectric fluid atomizer configured to atomize water from the water reservoir so as to generate a mist of water droplets at a mist generation site characterized in that the iron further comprises:

mist distribution means, configured to distribute the mist from the mist generation site to the at least one mist outlet opening, said mist distribution means comprising:

a distribution channel, extending from an air inlet, via the mist generation site, to the at least one mist outlet opening; and an air flow generator, disposed in or adjacent said distribution channel and configured to generate an airflow that transports the mist, from the mist generation site, through the distribution channel, to the at least one mist outlet opening, wherein a lower wall portion of the distribution channel includes a water accumulator, configured to gravitationally trap liquid water travelling over said wall portion.

3. The iron according to claim 2, wherein the water accumulator is thermally connected to the soleplate or another heating means, so as to facilitate the evaporation of liquid water trapped in the water accumulator.

4. An iron, comprising:

a water reservoir, configured to hold liquid water;

a soleplate, including at least one mist outlet opening;

water atomization means, including a piezoelectric fluid atomizer configured to atomize water from the water reservoir so as to generate a mist of water droplets at a mist generation site characterized in that the iron further comprises:

mist distribution means, configured to distribute the mist from the mist generation site to the at least one mist outlet opening, said mist distribution means comprising:

a distribution channel, extending from an air inlet, via the mist generation site, to the at least one mist outlet opening; and an air flow generator, disposed in or adjacent said distribution channel and configured to generate an airflow that transports the mist, from the mist generation site, through the distribution channel, to the at least one mist outlet opening, a soleplate temperature sensor, configured to generate a reference signal comprising information about a temperature of the soleplate; and control means, operably connected to the soleplate temperature sensor and configured to control a rate of mist generation by the water atomization means in dependence on said reference signal.

5. An iron, comprising:

a water reservoir, configured to hold liquid water;

a soleplate, including at least one mist outlet opening;

water atomization means, including a piezoelectric fluid atomizer configured to atomize water from the water reservoir so as to generate a mist of water droplets at a mist generation site characterized in that the iron further comprises:

mist distribution means, configured to distribute the mist from the mist generation site to the at least one mist outlet opening, said mist distribution means comprising:

a distribution channel, extending from an air inlet, via the mist generation site, to the at least one mist outlet opening; and an air flow generator, disposed in or adjacent said distribution channel and configured to generate an airflow that transports the mist, from the mist generation site, through the distribution channel, to the at least one mist outlet opening, control means, configured to control the air flow generator and the water atomization means in mutual dependence, such that a mist having a higher water density is transported by an air flow having a higher air flow rate, and vice versa.

6. An iron, comprising:

a water reservoir, configured to hold liquid water;

a soleplate, including at least one mist outlet opening;

water atomization means, including a piezoelectric fluid atomizer configured to atomize water from the water reservoir so as to generate a mist of water droplets at a mist generation site characterized in that the iron further comprises:

mist distribution means, configured to distribute the mist from the mist generation site to the at least one mist outlet opening, said mist distribution means comprising:

a distribution channel, extending from an air inlet, via the mist generation site, to the at least one mist outlet opening; and an air flow generator, disposed in or adjacent said distribution channel and configured to generate an airflow that transports the mist, from the mist generation site, through the distribution channel, to the at least one mist outlet opening, wherein the soleplate comprises a plurality of mist outlet openings, said mist outlet openings being divided into a plurality of groups, wherein each group is associated with at least one of dedicated water atomization means and a dedicated air flow generator, such that a mist outflow rate of said groups may be controlled independently of one another, and wherein the iron further comprises control means configured to control the dedicated air flow generators or the dedicated water atomization means.

7. An iron, comprising:

a water reservoir, configured to hold liquid water;

a soleplate, including at least one mist outlet opening;

water atomization means, including a piezoelectric fluid atomizer configured to atomize water from the water reservoir so as to generate a mist of water droplets at a mist generation site characterized in that the iron further comprises:

mist distribution means, configured to distribute the mist from the mist generation site to the at least one mist outlet opening, said mist distribution means comprising:

a distribution channel, extending from an air inlet, via the mist generation site, to the at least one mist outlet opening; and an air flow generator, disposed in or adjacent said distribution channel and configured to generate an airflow that transports the mist, from the mist generation site, through the distribution channel, to the at least one mist outlet opening, at least one groove, provided in an underside of the soleplate and extending from the at least one mist outlet opening provided therein.

8. The iron according to claim 7, wherein the at least one groove extends from the at least one mist outlet opening to a circumferential edge of the soleplate.

9. The iron according to claim 7, wherein the groove has a height (h) in the range of 0.1-15 mm or a width (w) in the range of 0.8-28 mm.

10. An iron, comprising:

a water reservoir, configured to hold liquid water;

a soleplate, including at least one mist outlet opening;

water atomization means, including a piezoelectric fluid atomizer configured to atomize water from the water reservoir so as to generate a mist of water droplets at a mist generation site characterized in that the iron further comprises:

mist distribution means, configured to distribute the mist from the mist generation site to the at least one mist outlet opening, said mist distribution means comprising:

a distribution channel, extending from an air inlet, via the mist generation site, to the at least one mist outlet opening; and an air flow generator, disposed in or adjacent said distribution channel and configured to generate an airflow that transports the mist, from the mist generation site, through the distribution channel, to the at least one mist outlet opening, wherein the distribution channel comprises a pressure relief exit through which an air flow can escape the iron when the at least one mist outlet opening is substantially blocked.

11. An iron, comprising:

a water reservoir, configured to hold liquid water;

a soleplate, including at least one mist outlet opening;

water atomization means, including a piezoelectric fluid atomizer configured to atomize water from the water reservoir so as to generate a mist of water droplets at a mist generation site characterized in that the iron further comprises:

mist distribution means, configured to distribute the mist from the mist generation site to the at least one mist outlet opening, said mist distribution means comprising:

a distribution channel, extending from an air inlet, via the mist generation site, to the at least one mist outlet opening; and an air flow generator, disposed in or adjacent said distribution channel and configured to generate an airflow that transports the mist, from the mist generation site, through the distribution channel, to the at least one mist outlet opening, an additive reservoir, configured to hold an additive or additive solution; and a controllable additive dosing valve, configured to selectively bring the additive reservoir in fluid communication with the water atomization means.

* * * * *